US008354984B2

(12) United States Patent
Choi

(10) Patent No.: US 8,354,984 B2
(45) Date of Patent: Jan. 15, 2013

(54) ORGANIC LIGHT EMITTING DISPLAY AND DRIVING METHOD THEREOF

(75) Inventor: Sang Moo Choi, Suwon (KR)

(73) Assignee: Samsung Display Co., Ltd., Yongin-si (KR)

( * ) Notice: Subject to any disclaimer, the term of this patent is extended or adjusted under 35 U.S.C. 154(b) by 860 days.

(21) Appl. No.: 11/245,997

(22) Filed: Oct. 7, 2005

(65) Prior Publication Data

US 2006/0097966 A1 May 11, 2006

(30) Foreign Application Priority Data

Nov. 8, 2004 (KR) ..... 10-2004-0090400

(51) Int. Cl.
*G09G 3/32* (2006.01)
*G09G 3/20* (2006.01)

(52) U.S. Cl. ..... 345/83; 345/77

(58) Field of Classification Search ..... 345/82, 345/83, 76, 77, 204
See application file for complete search history.

(56) References Cited

U.S. PATENT DOCUMENTS

| | | | | |
|---|---|---|---|---|
| 5,233,338 | A * | 8/1993 | Surguy | 345/88 |
| 6,229,506 | B1 | 5/2001 | Dawson et al. | |
| 6,847,341 | B2 | 1/2005 | Kimura et al. | |
| 7,154,454 | B2 * | 12/2006 | Okabe et al. | 345/76 |
| 7,196,682 | B2 * | 3/2007 | Lo | 345/82 |
| 2004/0012340 | A1 | 1/2004 | Yasuda et al. | |
| 2004/0021620 | A1 * | 2/2004 | Mikami et al. | 345/30 |
| 2004/0046719 | A1 * | 3/2004 | Wang et al. | 345/82 |
| 2005/0200572 | A1 * | 9/2005 | Weng | 345/76 |

FOREIGN PATENT DOCUMENTS

EP 0 478 186 A2 4/1992

(Continued)

OTHER PUBLICATIONS

SIPO Patent Gazette dated Aug. 6, 2008, with English abstract, for corresponding Chinese application 200510120311.2.

(Continued)

*Primary Examiner* — Amr Awad
*Assistant Examiner* — Randal Willis
(74) *Attorney, Agent, or Firm* — Christie, Parker & Hale, LLP

(57) ABSTRACT

An organic light emitting display and a driving method thereof, in which an image is displayed with uniform brightness. The organic light emitting display includes: a scan driver for supplying a plurality of first scan signals at substantially a same time to a plurality of scan lines in a first period of one frame and for supplying a plurality of second scan signals in sequence to the scan lines in a second period of the one frame; a data driver for supplying a predetermined voltage to a plurality of data lines in the first period and for supplying a plurality of data signals to the data lines in the second period; and a pixel portion comprising a plurality of pixels connected to the scan lines and the data lines, wherein, when the one frame is an odd-numbered frame, the scan driver supplies the second scan signals in a first scanning sequence and wherein, when the one frame is an even-numbered frame, the scan driver supplies the second scan signals in a second scanning sequence differing from the first scanning sequence. With this configuration, a threshold voltage difference between the pixels is stably compensated. Further, in one embodiment, the first scanning sequence is inversely related to the second scanning sequence, so that the emission times of all pixels are equalized on average.

24 Claims, 9 Drawing Sheets

FOREIGN PATENT DOCUMENTS

| | | | |
|---|---|---|---|
| JP | 05-265403 | A | 10/1993 |
| JP | 11-237606 | A | 8/1999 |
| JP | 2001-147676 | | 5/2001 |
| JP | 2002-358051 | A | 12/2002 |
| JP | 2003-216100 | A | 7/2003 |
| JP | 2004-093682 | A | 3/2004 |
| JP | 2004-294752 | A | 10/2004 |

OTHER PUBLICATIONS

European Search Report dated Jul. 7, 2006 for EP application No. 05110397.6, in the name of Samsung SDI Co., Ltd. corresponding to Korean priority KR 10-2004-0090400.

Patent Abstract of Japan, Publication No. 2001-147676, dated May 29, 2001, in the name of Kenichi Takatori, et al.

* cited by examiner

ORGANIC LIGHT EMITTING DISPLAY AND DRIVING METHOD THEREOF

CROSS-REFERENCE TO RELATED APPLICATION

This application claims priority to and the benefit of Korean Patent Application Nos. 10-2004-0090400, filed on Nov. 8, 2004, in the Korean Intellectual Property Office, the entire disclosure of which is incorporated herein by reference.

BACKGROUND

1. Field of the Invention

The present invention relates to an organic light emitting display and a driving method thereof, and more particularly, to an organic light emitting display and a driving method thereof, in which an image is displayed with uniform brightness.

2. Discussion of Related Art

Recently, various flat panel displays have been developed as alternatives to a relatively heavy and bulky cathode ray tube (CRT) display. The flat panel display includes a liquid crystal display (LCD), a field emission display (FED), a plasma display panel (PDP), an organic light emitting diode (OLED) display (herein also referred to an organic light emitting display), etc.

Among the flat panel displays, the organic light emitting display can emit light for itself by electron-hole recombination. Such an organic light emitting display has advantages of a relatively fast response time and a relatively low power consumption. Generally, the organic light emitting display employs a transistor provided in each pixel of the display for supplying a current corresponding to a data signal to an organic light emitting diode, thereby allowing the organic light emitting diode to emit light.

FIG. 1 illustrates a conventional organic light emitting display.

Referring to FIG. 1, a pixel 10 of a conventional organic light emitting display emits light corresponding to a data signal supplied to a data line Dm when a scan signal is applied to a scan line Sn.

As shown in FIG. 2, scan signals are applied to first through $n^{th}$ scan lines S through Sn in sequence. Further, data signals are supplied to first through $M^{th}$ data lines (e.g., the data line Dm), synchronizing with the scan signals.

As shown in FIG. 1, each pixel 10 includes a pixel circuit 12 connected to an organic light emitting diode OLED, the data line Dm and the scan line Sn. The pixel circuit 12 is connected to a first power source ELVDD and applies a current to the organic light emitting diode OLED. The organic light emitting diode OLED includes an anode electrode connected to the pixel circuit 12, and a cathode electrode connected to a second power source ELVSS (or a ground). Here, the organic light emitting diode OLED emits light corresponding to the current supplied from the pixel circuit 12.

In more detail, the pixel circuit 12 includes a second transistor M2 connected between the first power source ELVDD and the organic light emitting diode OLED, a first transistor M1 connected to the data line Dm and the scan line Sn, and a storage capacitor C connected between a gate electrode and a first electrode of the second transistor M2. Here, the first electrode can indicate either of a source electrode or a drain electrode. For example, when the first electrode is selected as the source electrode, the second electrode is selected as the drain electrode. On the other hand, when the first electrode is selected as the drain electrode, the second electrode is selected as the source electrode.

The first transistor M1 includes a gate electrode connected to the scan line Sn, a first electrode connected to the data line Dm, and a second electrode connected to the storage capacitor C. Here, the first transistor M1 is turned on when it receives the scan signal through the scan line S, thereby supplying the data signal from the data line D to the storage capacitor C. At this time, the storage capacitor C is charged with a voltage corresponding to the data signal.

The second transistor M2 includes the gate electrode connected to the storage capacitor C, the first electrode connected to the first power source line ELVDD, and a second electrode connected to the anode electrode of the organic light emitting diode OLED. Here, the second transistor M2 controls the amount of current flowing from the first power source ELVDD to the organic light emitting diode OLED. At this time, the organic light emitting diode OLED emits light with the brightness corresponding to the amount of current supplied from the second transistor M2.

Here, a current flowing in the organic light emitting diode OLED is determined by the following equation 1.

$$I_{OLED} = \frac{\beta}{2}(Vgs - |Vth|)^2 = \frac{\beta}{2}(VDD - Vdata - |Vth|)^2 \quad \text{[Equation 1]}$$

where, $I_{OLED}$ is a current flowing into the organic light emitting diode OLED, Vgs is a voltage applied between the gate electrode and the first electrode of the second transistor M2, Vth is the threshold voltage of the second transistor M2, Vdata is a voltage corresponding to the data signal, and β is a constant.

Referring to the equation 1, the current flowing into the organic light emitting diode OLED depends on the threshold voltage of the second transistor M2. Thus, each of threshold voltages of second transistors (e.g., the second transistor M2) should be uniform regardless of position of its corresponding pixel (e.g., the pixel 10) in order to display an image with uniform brightness. However, due to possible errors in a fabricating process, each of the threshold voltages of the second transistors (e.g., the second transistor M2) may vary according to the position of its corresponding pixel (e.g., the pixel 10), so that the organic light emitting display may display an image with non-uniform brightness.

SUMMARY OF THE INVENTION

An embodiment of the present invention provides an organic light emitting display and a driving method thereof, in which an image is displayed with uniform brightness.

One embodiment of the present invention provides an organic light emitting display including: a scan driver for supplying a plurality of first scan signals at substantially a same time to a plurality of scan lines in a first period of one frame and for supplying a plurality of second scan signals in sequence to the scan lines in a second period of the one frame; a data driver for supplying a predetermined voltage to a plurality of data lines in the first period and for supplying a plurality of data signals to the data lines in the second period; and a pixel portion including a plurality of pixels connected to the scan lines and the data lines, wherein, when the one frame is an odd-numbered frame, the scan driver supplies the second scan signals in a first scanning sequence and wherein, when the one frame is an even-numbered frame, the scan driver supplies the second scan signals in a second scanning sequence differing from the first scanning sequence.

According to an embodiment of the invention, the first scanning sequence is inversely related to the second scanning sequence. Further, in an embodiment, the scan driver supplies the second scan signals in sequence from a first one of the scan lines to a last one of the scan lines in the odd-numbered frame, and supplies the second scan signals in sequence from the last one of the scan lines to the first one of the scan lines in the even-numbered frame. Alternatively, in an embodiment, the scan driver supplies the second scan signals in sequence from a first one of the scan lines to a last one of the scan lines in the even-numbered frame, and supplies the second scan signals in sequence from the last one of the scan lines to the first one of the scan lines in the odd-numbered frame.

One embodiment of the present invention provides a method of driving an organic light emitting display, the method including: applying a plurality of first scan signals at substantially a same time to a plurality of scan lines in a first period of one frame; applying a predetermined voltage to a plurality of data lines in the first period; applying a plurality of second scan signals in a first scanning sequence to the scan lines in a second period of the one frame when the one frame is an odd-numbered frame; and applying the second scan signals in a second scanning sequence differing from the first scanning sequence to the scan lines in the second period of the one frame when the one frame is an even-numbered frame.

According to an embodiment of the invention, the first scanning sequence is inversely related to the second scanning sequence. Further, in an embodiment, the second scan signals are applied in sequence from a first one of the scan lines to a last one of the scan lines in the odd-numbered frame, and applied in sequence from the last one of the scan lines to the first one of the scan lines in the even-numbered frame. Alternatively, in an embodiment, the second scan signals are applied in sequence from a first one of the scan lines to a last one of the scan lines in the even-numbered frame, and applied in sequence from the last one of the scan lines to the first one of the scan lines in the odd-numbered frame.

BRIEF DESCRIPTION OF THE DRAWINGS

The accompanying drawings, together with the specification, illustrate exemplary embodiments of the present invention and together with the description serve to explain the principles of the invention.

DETAILED DESCRIPTION

In the following detailed description, certain exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, rather than restrictive.

Figure 1:
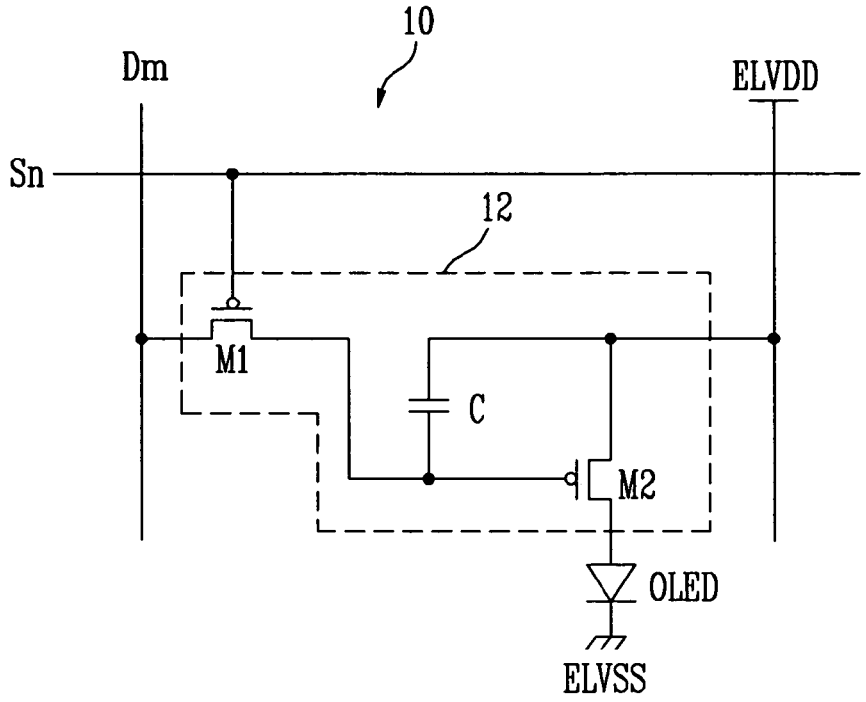
FIG. 1 (PRIOR ART)
FIG. 1 is a circuit diagram of a conventional pixel.
Figure 2:
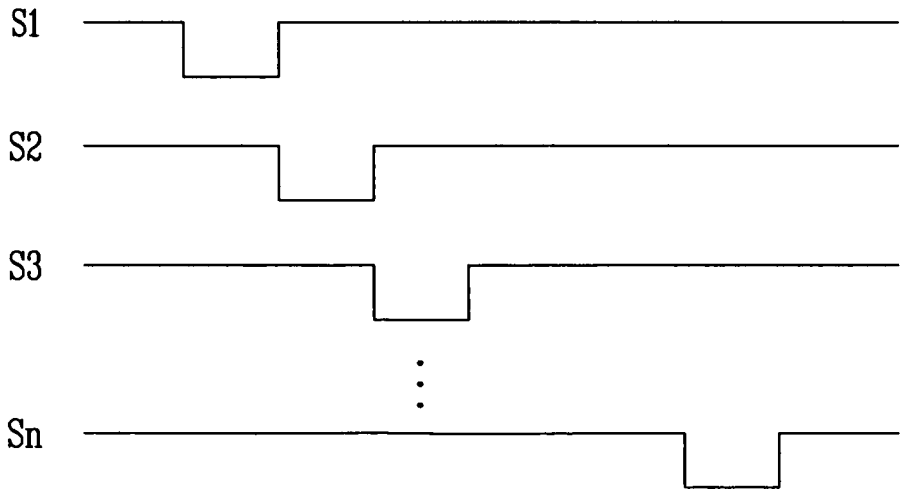
FIG. 2 (PRIOR ART)
FIG. 2 shows driving waveforms applied to the conventional pixel.
Figure 3:
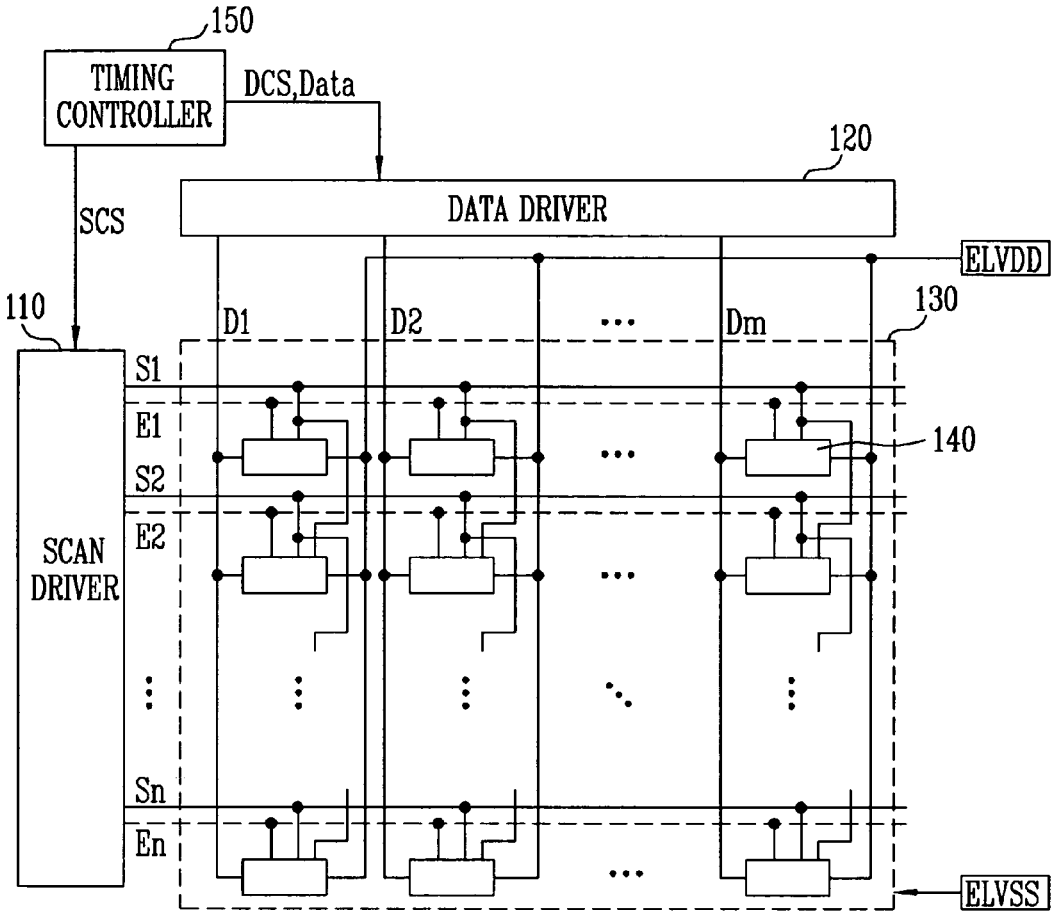
FIG. 3 is a layout diagram showing an organic light emitting display according to an embodiment of the present invention.

FIG. 3 illustrates an organic light emitting display according to an embodiment of the present invention.

Referring to FIG. 3, an organic light emitting display according to an embodiment of the present invention includes a pixel portion 130 including a plurality of pixels 140 formed in regions where scan lines S1 through Sn intersect (or cross) data lines D1 through Dm; a scan driver 110 to drive the scan lines S1 through Sn; a data driver 120 to drive the data lines D1 through Dm; and a timing controller 150 to control the scan driver 110 and the data driver 120.

The scan driver 110 receives a scan control signal SCS from the timing controller 150. In response to the scan control signal SCS, the scan driver 110 generates first scan signals and second scan signals. Here, the first scan signals are supplied to all scan lines S1 through Sn at the same time, but the second scan signals are supplied to the first through nth scan lines S1 through Sn in sequence. Further, the scan driver 110 generates first emission control signals and second emission control signals in response to the scan control signal SCS. Here, the first emission control signals are supplied to all emission control lines E1 through En at the same time, but the second emission control signals are supplied to the first through $n^{th}$ emission control lines E1 through En in sequence. Operations of the scan driver 110 will be described below in more detail.

The data driver 120 receives a data control signal DCS from the timing controller 150. Then, the data driver 120 generates data signals in response to the data control signal DCS, and supplies data signals to the data lines D1 through Dm every time a respective one of the second scan signals is supplied. Further, the data driver 120 supplies a predetermined voltage to the data lines D1 through Dm when the first scan signals are supplied to the scan lines S1 through Sn. Detailed operations of the data driver 120 will be described below in more detail.

The timing controller 150 generates the data control signal DCS and the scan control signal SCS in response to external synchronization signals. Here, the timing controller 150 supplies the data control signal DCS and the scan control signal SCS to the data driver 120 and the scan driver 110, respectively. Further, the timing controller 150 supplies external data Data to the data driver 120.

The pixel portion 130 includes the plurality of pixels 140. Each pixel 140 receives an external first power ELVDD and an external second power ELVSS, and emits light corresponding to a respective one of the data signals.

Figure 4:
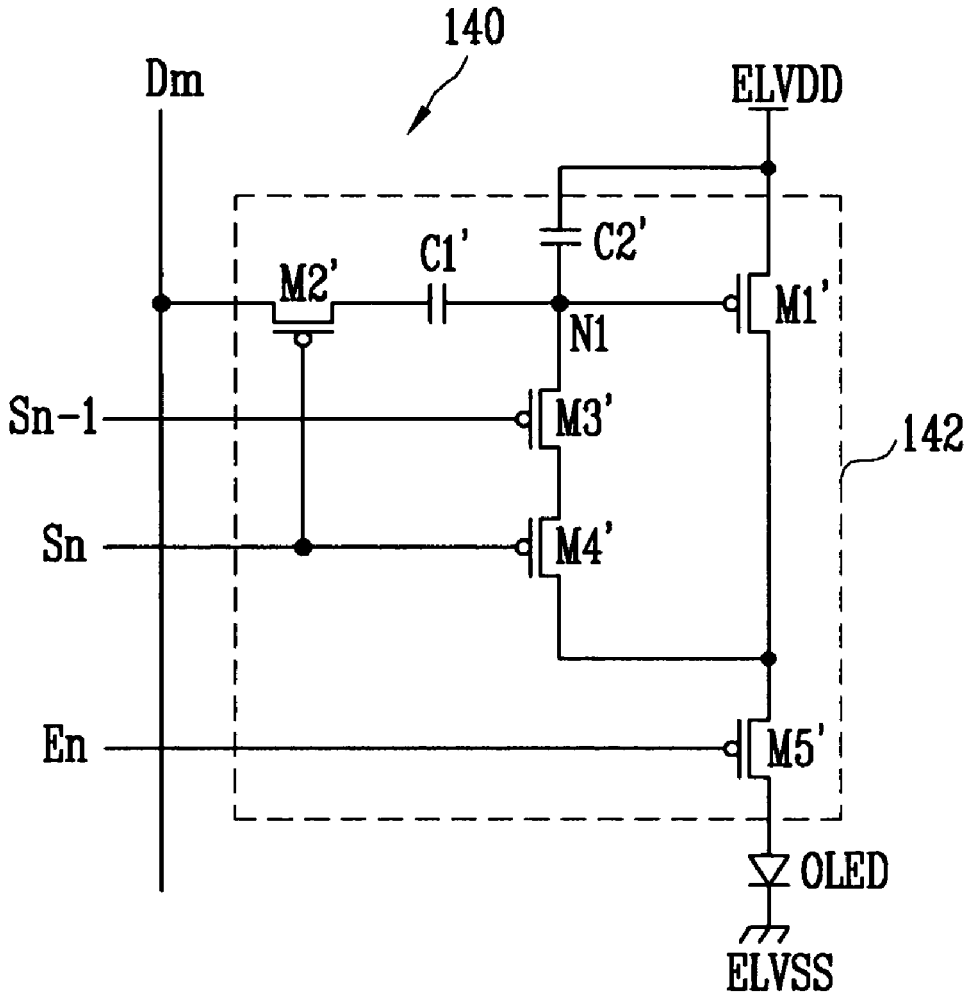
FIG. 4 is a circuit diagram of a pixel according to an embodiment of the present invention.

FIG. 4 is a circuit diagram of a pixel according to an embodiment of the present invention. For exemplary purposes, FIG. 4 illustrates the pixel 140 connected to the $m^{th}$ data line Dm, the $(n-1)^{th}$ scan line Sn−1, and the $n^{th}$ scan line Sn.

Referring to FIG. 4, the pixel 140 according to an embodiment of the present invention includes a pixel circuit 142 connected to the $m^{th}$ data line Dm, the $(n-1)^{th}$ scan line Sn−1, the $n^{th}$ scan line Sn, and the $n^{th}$ emission control line En, and controlling an organic light emitting diode OLED.

The organic light emitting diode OLED includes an anode electrode connected to the pixel circuit 142, and a cathode electrode connected to a second power source ELVSS. Here, the second power ELVSS has a lower voltage than a first power ELVDD; e.g., the second power ELVSS has a ground voltage. The organic light emitting diode OLED emits light corresponding to a current supplied from the pixel circuit 142.

The pixel circuit 142 includes first and fifth transistors M1' and M5' connected between the first power source ELVDD and the organic light emitting diode OLED; a second transistor M2' and a first capacitor C1' connected between the first transistor M1' and the $m^{th}$ data line Dm'; third and fourth transistors M3' and M4'; and a second capacitor C2' connected between first and gate electrodes of the first transistor M1'.

The second transistor M2' includes a first electrode connected to the $m^{th}$ data line Dm, a gate electrode connected to the $n^{th}$ scan line Sn, and a second electrode connected to a first terminal of the first capacitor C1'. Here, the second transistor M2' is turned on when a respective one of the second scan signals is transmitted to the $n^{th}$ scan line Sn, and supplies a respective one of the data signals from the $m^{th}$ data line to the first terminal of the first capacitor C1'.

The first transistor M1' includes the gate electrode connected to a first node N1, the first electrode connected to the first power source ELVDD, and a second electrode connected to a first electrode of the fifth transistor M5'. Here, the first transistor M1' supplies a current corresponding to a voltage stored in the first and second capacitors C1' and C2' to the fifth transistor M5'.

The third transistor M3' includes a gate electrode connected to the $(n-1)^{th}$ scan line Sn−1, a first electrode connected to the first node N1, and a second electrode connected to a first electrode of the fourth transistor M4'. Here, the third transistor M3' is turned on when a respective one of the first scan signals or a respective one of the second scan signals is supplied to the $(n-1)^{th}$ scan line Sn−1.

The fourth transistor M4' includes a gate electrode connected to the $n^{th}$ scan line Sn, the first electrode connected to the second electrode of the third transistor M3', and a second electrode connected to the first electrode of the fourth transistor M4'. Here, the fourth transistor M4' is turned on when a respective one of the first scan signals or a respective one of the second scan signals is supplied to the $n^{th}$ scan line Sn. Further, the third transistor M3' and the fourth transistor M4' are connected between the gate electrode and the second electrode of the first transistor M1'. Thus, when the third transistor M3' and the fourth transistor M4' are turned on at the same time, the first transistor M1' is connected like a diode. Also, the third transistor M3' and the fourth transistor M4' are controlled by different scan lines Sn−1 and Sn, so that the current flowing from the first node N1 to the first electrode of the fifth transistor M5' is prevented from leaking, which will be described later in more detail.

The fifth transistor M5 includes a gate electrode connected to the $n^{th}$ emission control line En, the first electrode connected to both the second electrodes of the first and fourth transistors M1' and M4', and a second electrode connected to the anode electrode of the organic light emitting diode OLED. Here, the fifth transistor M5' is turned off only when a respective one of the first emission control signals or a respective one of the second emission control signals is supplied to the $n^{th}$ emission control line En.

The first and second capacitors C1' and C2' are each charged with a voltage corresponding to the threshold voltage of the first transistor M1' and the respective one of the data signals, and supply the charged voltage to the gate electrode of the first transistor M1'.

Figure 5A:
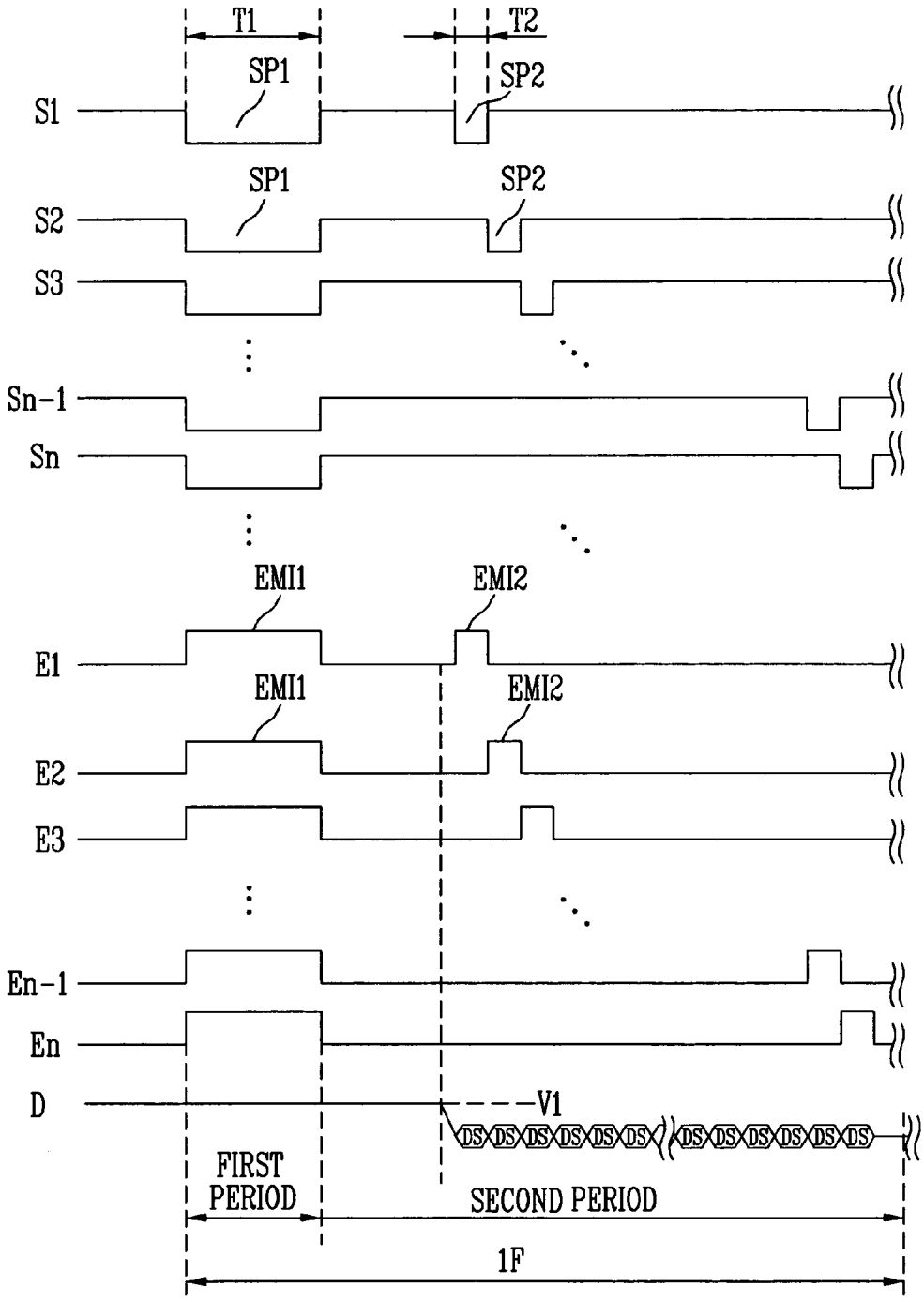
FIGS. 5A and 5B show first driving waveforms applied to a pixel according to an embodiment of the present invention.
Figure 5B:
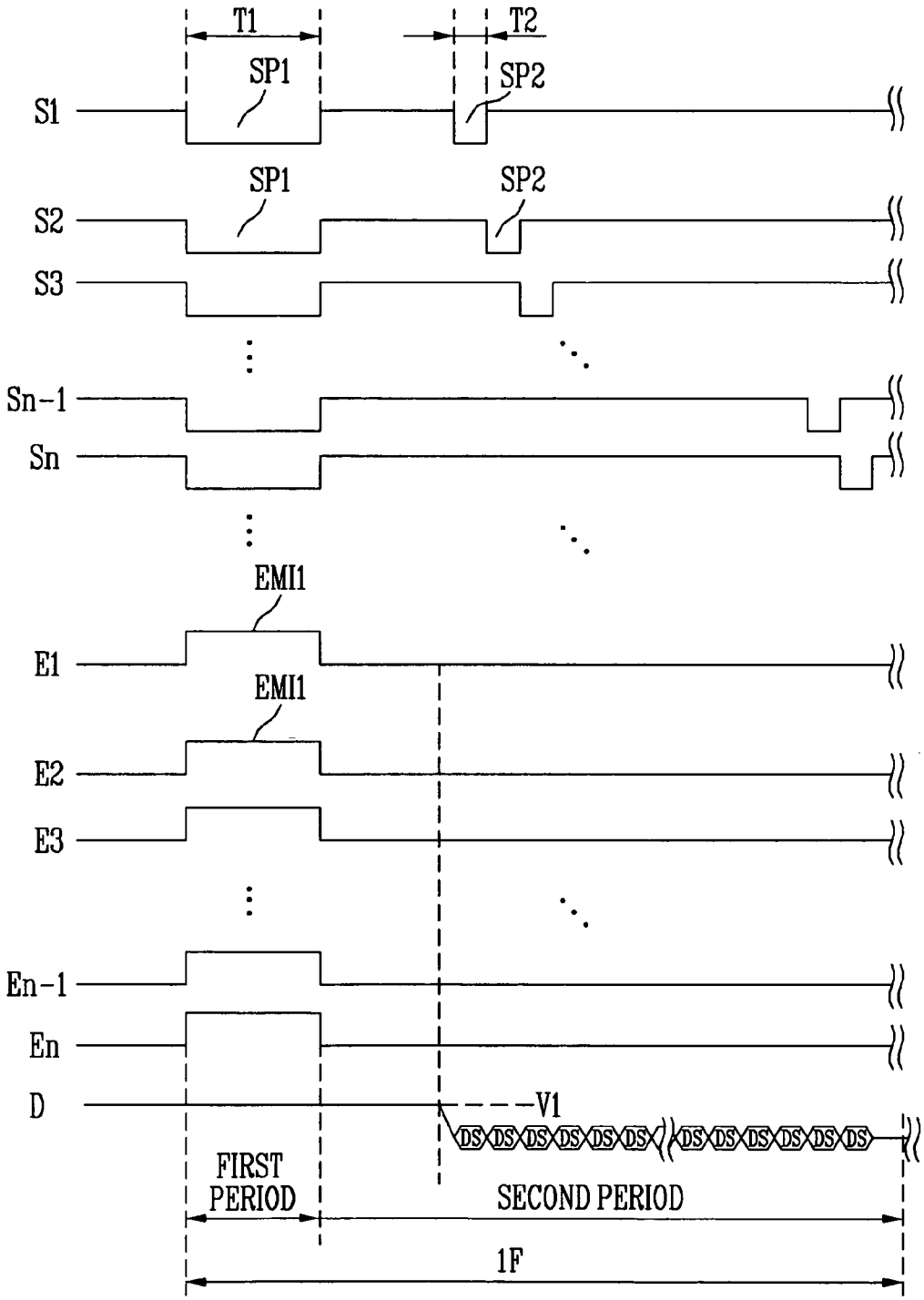

FIGS. 5A and 5B show first driving waveforms applied to a pixel according to an embodiment of the present invention.

Referring to FIG. 5A, one frame 1F is divided into a first period and a second period. In the first period, the threshold voltage of the first transistor M1' provided in each pixel 140 is compensated. In the second period, a respective one of the data signals is supplied to each pixel 140, thereby displaying an image with desired brightness.

In the first period, the scan driver 110 supplies the first scan signals SP1 to all scan lines S1 through Sn at the same time. In the second period, the scan driver 110 supplies the second scan signals SP2 to the first scan line S1 through the $n^{th}$ scan line Sn in sequence. Here, the width T1 of each of the first scan signals SP1 is wider than the width T2 of each of the second scan signals SP2 so as to fully compensate the threshold voltage of the first transistor M1'. That is, the time of applying each of the first scan signals SP1 is longer than the time of applying each of the second scan signals SP2.

Further, the scan driver 110 supplies the first emission control signals EMI1 to the emission control lines E1 through En during the first period. As the first emission control signals EMI1 are supplied, the fifth transistor M5' provided in each pixel 140 is turned off. Further, the scan driver 110 supplies the second emission control signals EMI2 to the first emission control line E1 through the $n^{th}$ emission control line En in sequence during the second period. Here, the width of each of the first emission control signals EMI1 is wider than the width of each of the second emission control signal EMI2. That is, the time of applying each of the first emission control signals EMI1 is longer than the time of applying each of the second emission control signals EMI2.

In the first period, the data driver 120 supplies a predetermined voltage V1 to all data lines D1 through Dm in order to stably compensate the threshold voltage of the first transistor M1'. Here, the voltage V1 is higher than the highest voltage of the data signals supplied from the data driver 120. For example, in the case where the data signals supplied from the data driver 120 have voltages varying from 2V to 4V, the voltage V1 is set to be higher than the 4V. Alternatively, the voltage V1 may be equal to the voltages of the first power ELVDD. In the second period, the data driver 120 supplies data signals DS to the data lines D1 through Dm to be synchronized with the second scan signals SP2.

Referring to FIGS. 4 and 5A, the pixel 140 operates as follows. During the first period, the first scan signals SP1 are supplied to all scan lines S1 through Sn, and at the same time the first emission control signals EMI1 are supplied to all emission control lines En. Further, the voltage V1 is supplied to all data lines D1 through Dm in the first period. Here, for the sake of convenience, it is assumed that the voltage V1 is equal to the voltage of the first power ELVDD.

When the first scan signals SP1 are supplied to all scan lines S1 though Sn, the second, third and fourth transistors M2', M3' and M4' are turned on. As the third and fourth transistors M3' and M4' are turned on, the first transistor M1' is connected like a diode. Therefore, a voltage obtained by subtracting the threshold voltage of the first transistor M1' from the first power ELVDD is applied to the first node N1. At this time, the second transistor M2' is also turned on, so that the voltage V1 (having the same level as the voltage of the first power ELVDD) is supplied to the first terminal of the first capacitor C1'. Then, the first capacitor C1' is charged with a voltage corresponding to the threshold voltage of the first transistor M1'. Likewise, the second capacitor C2' is charged with a voltage corresponding to the difference between the voltage applied to the first node N1 and the voltage of the first power ELVDD. That is, the second capacitor C2' is charged with the threshold voltage of the first transistor M1'.

In the meantime, the width (or time) T1 for applying each of the first scan signals SP1 is set to stably charge the first and second capacitors C1' and C2' with enough voltage. Therefore, the threshold voltage of the first transistor M1' is stably compensated during the first period. According to an embodiment of the present invention, the threshold voltage is not compensated while the second scan signals SP2 are supplied to the scan lines S1 through Sn in sequence but is instead compensated during the separate first period, so that the first period can be set to be long enough to stably compensate the threshold voltage of the first transistor M1'.

In the second period, the second scan signals SP2 are sequentially supplied to the scan lines S1 though Sn, and at the same time the second emission control signals EMI2 are sequentially supplied to the emission control lines E1 through En. Further, in the second period, the data signals DS are supplied to the data lines D1 through Dm while synchronizing with the second scan signals SP2.

When the respective one of the second scan signals SP2 is supplied to the $(n-1)^{th}$ scan line Sn−1, the third transistor M3' is turned on. At this time, the second transistor M2' and the fourth transistor M4' are kept being turned off. Therefore, even though the third transistor M3' is turned on, the leakage current due to the voltage charged in the first and second capacitors C1' and C2' is not supplied to the fifth transistor M4'. That is, in the second period, the third and fourth transistors M3' and M4' are turned on at different times, thereby preventing the leakage current due to the voltage charged in the first and second capacitors C1' and C2'.

When the respective one of the second scan signals SP2 is supplied to the $n^{th}$ scan line Sn, the second transistor M2' and the fourth transistor M4' are turned on. As the second transistor M2' is turned on, the voltage corresponding to the respective one of the data signals DS is charged in the first and second capacitors C1' and C2'. Here, the voltage applied to the gate and source electrodes of the first transistor M1' is determined by the following equation 2 in consideration of the voltage previously charged in the first and second capacitors C1' and C2'.

$$Vgs = VDD - |Vth| - Vdata\frac{C1}{C2} \quad \text{[Equation 2]}$$

where, Vgs is a voltage applied to the gate and first electrodes of the first transistor M1'; Vth is the threshold voltage of the first transistor M1'; Vdata is a voltage of the data signal; C1 is the capacitance of the first capacitor C1'; and C2 is the capacitance of the second capacitor C2'.

Here, the threshold voltage Vth is canceled by substituting the Vgs of the equation 2 for that of the equation 1. In result, an image can be displayed with uniform brightness regardless of the threshold voltage of the first transistor M1'.

The first transistor M1' supplies a current corresponding to the voltage stored in the first and second capacitors C1' and C2' to the first electrode of the fifth transistor M5'. In the meantime, when the second scan signal SP2 is supplied to the $n^{th}$ scan line Sn, the respective one of the second emission control signals EMI2 is supplied to the $n^{th}$ emission control line En. As the respective one of the second emission control signals EMI2 is supplied, the fifth transistor M5' is turned off, thereby interrupting the current flowing to the organic light emitting diode OLED when the respective one of the second scan signals SP2 is supplied to the $n^{th}$ scan line Sn. Thereafter, the respective one of the second emission control signals EMI2 is stopped from being supplied to the $n^{th}$ emission control line En, thereby turning on the fifth transistor M5'. Then, the current is supplied from the first transistor M1' to the organic light emitting diode OLED, so that the organic light emitting diode OLED emits light with predetermined brightness.

Alternatively, in an embodiment as shown in FIG. 5B, the first emission control signals EMI1 are supplied to the emission control lines E1 through En in the first period, but the second emission control signals EMI2 are not supplied to the emission control lines E1 through En in the second period. In other words, the threshold voltage of the first transistor M1' is compensated during the separate first period, so that an image is stably displayed even though the second emission control signals EMI2 are not supplied in the second period. In the embodiment of FIG. 5B, since the first through $n^{th}$ emission control lines E1 through En receive uniform driving waveforms, the first through $n^{th}$ emission control lines E1 through En can be commonly connected to one another.

Figure 6:
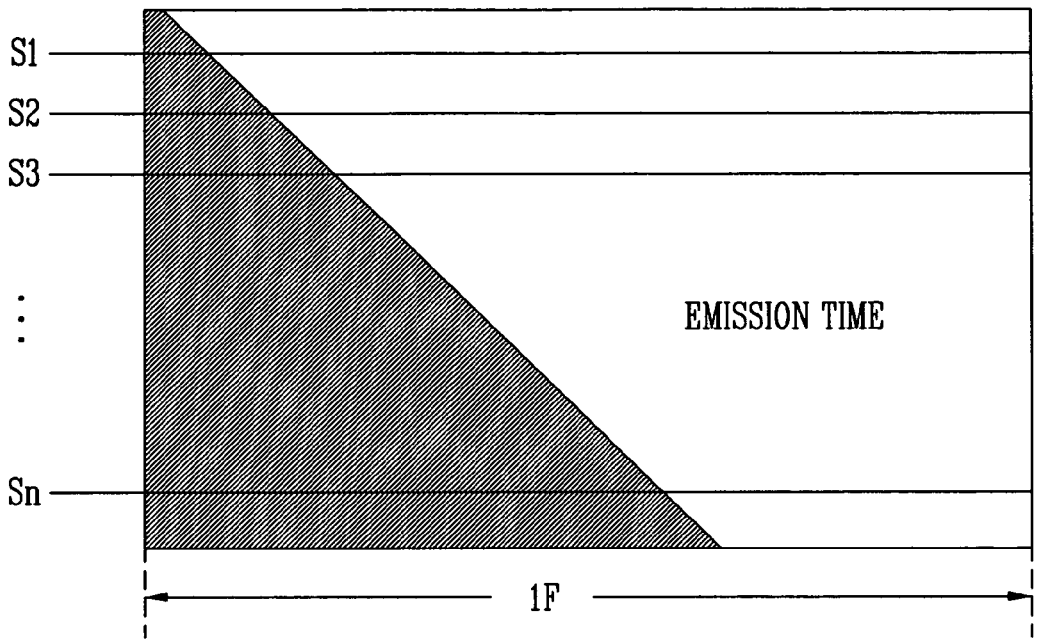
FIG. 6 shows the length of emission times of pixels according to an embodiment of the present invention when the first driving waveforms of FIGS. 5A and 5B are applied.

However, referring to FIG. 6, in the foregoing organic light emitting display, the respective pixels 140 have different periods (or lengths) of emission time according to scanning sequence of the second scan signals SP2. That is, while the driving waveforms are supplied as shown in FIGS. 5A and 5B, the period of the emission time for an emitting pixel 140 decreases as the emitting pixel 140 moves from being the pixel 140 connected to the first scan line S1 to the pixel 140 connected to the $n^{th}$ scan line Sn.

In more detail, the first and second capacitors C1' and C2' of each pixel 140 are charged with the voltage corresponding to the respective one of data signals of when the respective one of second scan signals SP2 is supplied. Thus, a respective one of the pixels 140 emits light from the time when its second scan signal SP2 is supplied. Further, the voltage charged in the first and second capacitors C1' and C2' is changed into the voltage corresponding to the threshold voltage of the first transistor M1' when the respective one of the first scan signals SP1 is supplied. Therefore, the length of the emission time for each pixel 140 is related to a point of time when the respective one of the second scan signals SP2 is supplied and a point of time when the respective one of the first scan signals SP1 is supplied. Here, the second scan signals SP2 are sequentially supplied to the first scan line S1 through the $n^{th}$ scan line Sn, so that the pixels 140 have different periods of the emission time. For example, the pixel 140 first receiving its second scan signal SP2 has a longer emission time than the pixel 140 later receiving its second scan signal SP2.

In an enhancement of the above-described embodiments, an embodiment of the present invention provides scanning sequences of the second scan signals SP2 that are alternately inversed between an odd-numbered frame and an even-numbered frame. That is, for example, in the odd-numbered frame, the scan driver 100 supplies the second scan signals SP2 in sequence from the first scan line S1 to the $n^{th}$ scan line Sn (refer to FIGS. 5A and 5B). On the other hand, in the even-numbered frame, the scan driver 100 supplies the second scan signals SP2 in sequence from the $n^{th}$ scan line Sn to the first scan line S1. In the case where the supply of the second scan signal SP2 is started at the $n^{th}$ scan line Sn as shown in FIGS. 7A and 7B, the period of emission time for an emitting pixel 140 decreases as the emitting pixel 140 moves from being the pixel 140 connected to the $n^{th}$ scan line Sn to the pixel 140 connected to the first scan line S1 as shown in FIG. 8.

As the odd frame and the even frame are different in their respective scanning sequences of the second scan signals SP2, the periods of the emission times for respective pixels 140 are equalized on the average. For example, when a pixel 140 has a relatively short emission time in the odd-numbered frame, it has a relatively long emission time in the even-numbered frame. Thus, the periods of the emission times for respective pixels 140 are equalized on the average, thereby displaying an image with uniform brightness.

Figure 7A:
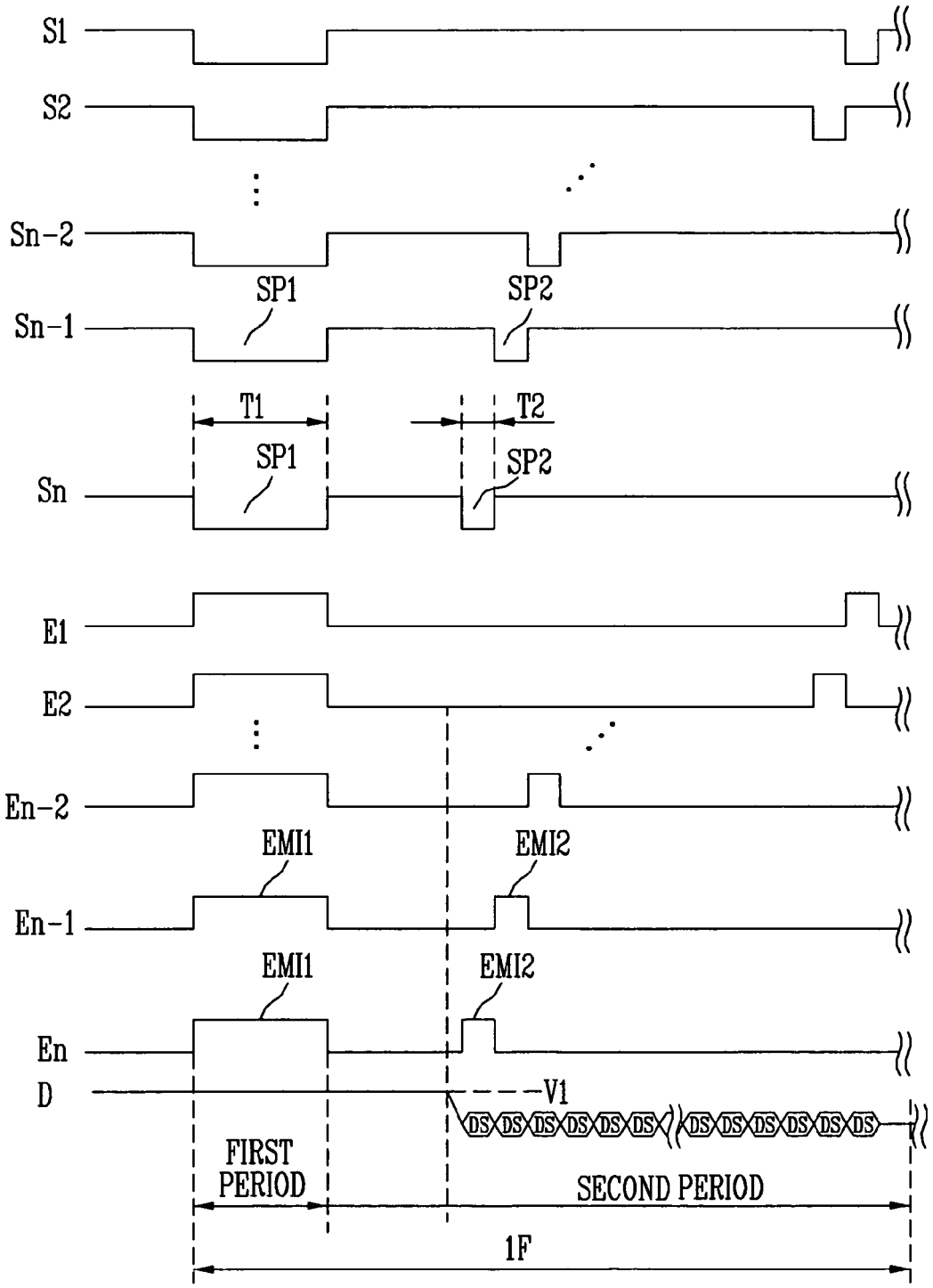
FIGS. 7A and 7B show second driving waveforms applied to a pixel according to an embodiment of the present invention.
Figure 7B:
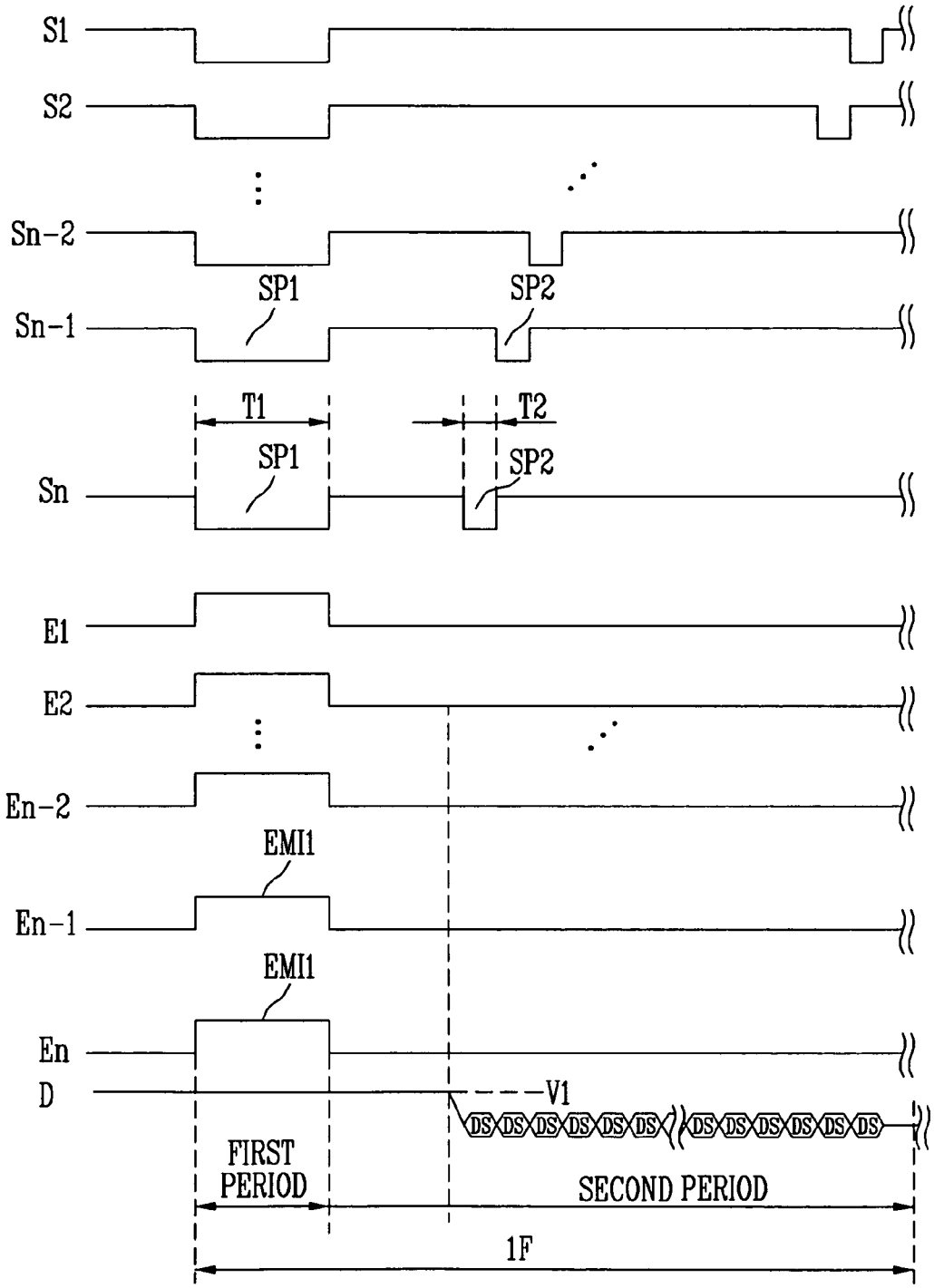
Figure 8:
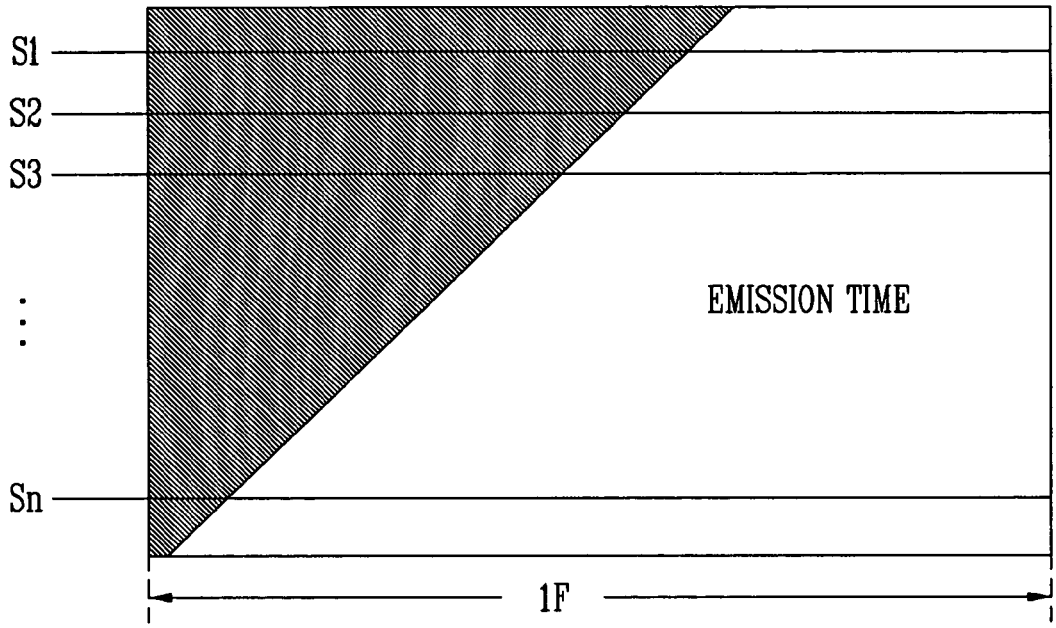
FIG. 8 shows the length of emission times of pixels according to an embodiment of the present invention when the second driving waveforms of FIGS. 7A and 7B are applied.

Likewise, when the supply of the second scan signals SP2 is started at the $n^{th}$ scan line Sn as shown in FIG. 7A, the second emission control signals EMI2 have the same supplying sequence as the second scan signals SP2. For example, when the second scan signals SP2 are supplied in sequence of from the $n^{th}$ scan line Sn to the first scan line S1, the second emission control signals EMI2 are also supplied in sequence of from the $n^{th}$ emission control line En to the first emission control line E1. On the other hand, in an embodiment as shown in FIG. 7B, the second emission control signals EMI2 are not supplied in the second period.

Alternatively, according to an embodiment of the present invention, in the even-numbered frame, the second scan signals SP2 may be supplied in sequence of from the first scan line S1 to the $n^{th}$ scan line Sn (refer to FIGS. 5A and 5B); and, in the odd-numbered frame, the second scan signals SP2 may be supplied in sequence of from the $n^{th}$ scan line Sn to the first scan line S1.

As described above, the present invention provides an organic light emitting display and a driving method thereof, in which a voltage corresponding to a threshold voltage of a first transistor is charged in first and second capacitors of a pixel in a first period of one frame, thereby compensating differences between threshold voltages of a plurality of first transistors. As the threshold voltages of the first transistors provided in the respective pixels are compensated, the organic light emitting display can display an image with uniform brightness. Further, according to an embodiment of the present invention, the first period is set to fully compensate the threshold voltage of the first transistor, thereby stably compensating the threshold voltage of the first transistor. Also, according to an embodiment of the present invention, two other transistors are provided between a gate terminal and a second terminal of the first transistor and connected to different scan lines, thereby preventing a leakage current. Additionally, according to an embodiment of the present invention, scanning sequences of second scan signals are alternately inversed between an odd-numbered frame and an even-numbered frame, thereby equalizing the period of emission time for all pixels on the average.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. An organic light emitting display comprising:

a scan driver for supplying a plurality of first scan signals at a same time and for a same duration to a plurality of scan lines and for supplying a plurality of first emission control signals at the same time and for the same duration as the supplying of the plurality of first scan signals to a plurality of emission control lines formed in parallel with the plurality of scan lines in a first period of one frame, and for supplying a plurality of second scan signals in sequence to the scan lines and a plurality of second emission control signals to the emission control lines in a second period of the one frame, each of the first emission control signals having a longer supplying time period than each of the second emission control signals;

a data driver for supplying a first voltage to a plurality of data lines in the first period and for supplying a plurality of data signals to the data lines in the second period; and a pixel portion comprising a plurality of pixels connected to the scan lines and the data lines, each of the pixels comprising an organic light emitting diode and a fifth transistor for supplying a light emission current to the organic light emitting diode, the fifth transistor being configured to be non-conducting in response to a corresponding one of the first emission control signals supplied to a corresponding one of the emission control lines or a corresponding one of the second emission control signals supplied to the corresponding one of the emission control lines, to interrupt the light emission current flowing to the organic light emitting diode, wherein each of the pixels further comprises:

a second transistor connected to a respective one of the data lines and an $n^{th}$ scan line of the scan lines (where, n is a natural number);

first and second capacitors connected in series between the second transistor and a first power source;

a first transistor connected between the first power source and a first node formed, between the first and second transistors and for supplying the light emission current according to a voltage charged in the first and second capacitors to the organic light emitting diode;

a third transistor connected between the first node and an electrode of the first transistor, and controlled by an $(n-1)^{th}$ scan line of the scan lines; and a fourth transistor connected between the electrode of the first transistor and an electrode of the third transistor, and controlled by the $n^{th}$ scan line of the scan lines, and wherein, when the one frame is an odd-numbered frame, the scan driver supplies the second scan signals in a first scanning sequence and wherein, when the one frame is an even-numbered frame, the scan driver supplies the second scan signals in a second scanning sequence differing from the first scanning sequence.

2. The organic light emitting display according to claim 1, wherein the first scanning sequence is inversely related to the second scanning sequence.

3. The organic light emitting display according to claim 1, wherein the scan driver is configured to supply the second scan signals in sequence from a first one of the scan lines to a last one of the scan lines in the odd-numbered frame, and to supply the second scan signals in sequence from the last one of the scan lines to the first one of the scan lines in the even-numbered frame.

4. The organic light emitting display according to claim 1, wherein the scan driver is configured to supply the second scan signals in sequence from a first one of the scan lines to a last one of the scan lines in the even-numbered frame, and to supply the second scan signals in sequence from the last one of the scan lines to the first one of the scan lines in the odd-numbered frame.

5. The organic light emitting display according to claim 1, wherein each of the first scan signals has a longer supplying time period than each of the second scan signals.

6. The organic light emitting display according to claim 1, wherein the scan driver is configured to supply the plurality of second emission control signals in sequence to the emission control lines in the second period.

7. The organic light emitting display according to claim 6, wherein the scan driver is configured to supply the second emission control signals in the first scanning sequence in the odd-numbered frame, and to supply the second emission control signals in second scanning sequence in the even-numbered frame.

8. The organic light emitting display according to claim 1, wherein the first voltage is higher in voltage level than voltages of the data signals.

9. The organic light emitting display according to claim 1, wherein the first and second periods are not overlapped with each other in the one frame.

10. An organic light emitting display comprising:

a scan driver for supplying a plurality of first scan signals at a same time to a plurality of scan lines in a first period of one frame and for supplying a plurality of second scan signals in sequence to the scan lines in a second period of the one frame;

a data driver for supplying a first voltage to a plurality of data lines in the first period and for supplying a plurality of data signals to the data lines in the second period; and a pixel portion comprising a plurality of pixels connected to the scan lines and the data lines, wherein, when the one frame is an odd-numbered frame, the scan driver supplies the second scan signals in a first scanning sequence and wherein, when the one frame is an even-numbered frame, the scan driver supplies the second scan signals in a second scanning sequence differing from the first scanning sequence, wherein each of the pixels comprises:

an organic light emitting diode;

a second transistor connected to a respective one of the data lines and an $n^{th}$ scan line of the scan lines (where, n is a natural number);

first and second capacitors connected in series between the second transistor and a first power source;

a first transistor connected between the first power source and a first node formed between the first and second transistors and for supplying a light emission current according to a voltage charged in the first and second capacitors to the organic light emitting diode;

a third transistor connected between the first node and an electrode of the first transistor, and controlled by an $(n-1)^{th}$ scan line of the scan lines; and a fourth transistor connected between the electrode of the first transistor and an electrode of the third transistor, and controlled by the $n^{th}$ scan line of the scan lines.

11. The organic light emitting display according to claim 10, wherein the first voltage is substantially equal to a voltage supplied by the first power source.

12. The organic light emitting display according to claim 10, wherein the first and second capacitors are configured to be charged with the voltage corresponding to a threshold voltage of the first transistor when the first scan signals are supplied.

13. The organic light emitting display according to claim 10, further comprising a fifth transistor provided between the first transistor and the organic light emitting diode and connected to an $n^{th}$ emission control line of a plurality of emission control lines.

14. A method of driving organic light emitting display, the method comprising:

applying a plurality of first scan signals at a same time and for a same duration to a plurality of scan lines in a first period of one frame;

applying a plurality of first emission control signals at the same time and for the same duration as the applying of the plurality of first scan signals to a plurality of emission control lines in the first period to configure an emission control transistor to be non-conducting in each of a plurality of pixels connected to the scan lines and a plurality of data lines to interrupt a light emission current flowing to an organic light emitting diode in a corresponding one of the pixels;

wherein each of the pixels further comprises:

a second transistor connected to a respective one of the data lines and an $n^{th}$ scan line of the scan lines (where, n is a natural number);

first and second capacitors connected in series between the second transistor and a first power source;

a first transistor connected between the first power source and a first node formed between the first and second transistors and for supplying the light emission current according to a voltage charged in the first and second capacitors to the organic light emitting diode;

a third transistor connected between the first node and an electrode of the first transistor, and controlled by an $(n-1)^{th}$ scan line of the scan lines; and a fourth transistor connected between the electrode of the first transistor and an electrode of the third transistor, and controlled by the $n^{th}$ scan line of the scan lines, applying a first voltage to the plurality of data lines in the first period;

applying a plurality of second scan signals in a first scanning sequence to the scan lines in a second period of the one frame when the one frame is an odd-numbered frame;

applying the second scan signals in a second scanning sequence differing from the first scanning sequence to the scan lines in the second period of the one frame when the one frame is an even-numbered frame; and applying a plurality of second emission control signals to the emission control lines in the second period to configure the emission control transistor to be non-conducting, each of the first emission control signals having a longer supplying time period than each of the second emission control signals.

15. The method according to claim 14, wherein the first scanning sequence is inversely related to the second scanning sequence.

16. The method according to claim 14, wherein the second scan signals are applied in sequence from a first one of the scan lines to a last one of the scan lines in the odd-numbered frame, and applied in sequence from the last one of the scan lines to the first one of the scan lines in the even-numbered frame.

17. The method according to claim 14, wherein the second scan signals are applied in sequence from a first one of the scan lines to a last one of the scan lines in the even-numbered frame, and applied in sequence from the last one of the scan lines to the first one of the scan lines in the odd-numbered frame.

18. The method according to claim 14, wherein each of the first scan signals has a longer application time period than each of the second scan signals.

19. The method according to claim 14, further comprising applying a plurality of data signals to the data lines when the second scan signals are applied.

20. The method according to claim 19, wherein the first voltage is higher in voltage level than voltages of the data signals.

21. The method according to claim 19, wherein the first voltage is substantially equal to a voltage supplied by the first power source.

22. The method according to claim 14, wherein the plurality of second emission control signals are applied in sequence to the emission control lines in the second period.

23. The method according to claim 22, wherein the second emission control signals are applied in the first scanning sequence in the odd-numbered frame, and applied in the second scanning sequence in the even-numbered frame.

24. The method according to claim 14, wherein the first and second periods are not overlapped with each other in the one frame.

* * * * *

UNITED STATES PATENT AND TRADEMARK OFFICE

CERTIFICATE OF CORRECTION

PATENT NO. : 8,354,984 B2
APPLICATION NO. : 11/245997
DATED : January 15, 2013
INVENTOR(S) : Sang Moo Choi It is certified that error appears in the above-identified patent and that said Letters Patent is hereby corrected as shown below:

In the Claims

Column 11, Claim 14, line 33 — After "driving"
Insert -- an --

Signed and Sealed this
Tenth Day of June, 2014

Michelle K. Lee

Michelle K. Lee
*Deputy Director of the United States Patent and Trademark Office*